US009091048B2

(12) United States Patent
Arthurs et al.

(10) Patent No.: US 9,091,048 B2
(45) Date of Patent: Jul. 28, 2015

(54) TOILET REMOVAL AND DISPOSAL TRAY

(71) Applicants: Thomas A. Arthurs, Naples, FL (US); Jody A. Arthurs, Naples, FL (US)

(72) Inventors: Thomas A. Arthurs, Naples, FL (US); Jody A. Arthurs, Naples, FL (US)

( * ) Notice: Subject to any disclaimer, the term of this patent is extended or adjusted under 35 U.S.C. 154(b) by 0 days.

(21) Appl. No.: 14/323,383

(22) Filed: Jul. 3, 2014

(65) Prior Publication Data

US 2015/0001869 A1 Jan. 1, 2015

(51) Int. Cl.
*A45F 5/00* (2006.01)
*E03D 11/13* (2006.01)

(52) U.S. Cl.
CPC ..... *E03D 11/135* (2013.01)

(58) Field of Classification Search
USPC ..... 294/15, 144, 145, 169, 142, 158; 4/252.1; 269/15; 280/47.17, 47.34
See application file for complete search history.

(56) References Cited

U.S. PATENT DOCUMENTS

| | | | | |
|---|---|---|---|---|
| 3,179,287 | A * | 4/1965 | Rickmeier, Jr. | 220/324 |
| 3,391,905 | A | 7/1968 | Burns | |
| 3,745,974 | A * | 7/1973 | Karasz | 294/1.3 |
| 5,074,572 | A | 12/1991 | Delmerico et al. | |
| 5,184,653 | A | 2/1993 | Lacy | |
| 5,344,161 | A * | 9/1994 | Sandgren | 277/360 |
| 5,373,593 | A | 12/1994 | Decky et al. | |
| 5,505,430 | A | 4/1996 | Barnett | |
| 5,556,076 | A | 9/1996 | Jacquay | |
| 6,135,466 | A | 10/2000 | Irwin | |
| 6,254,152 | B1 * | 7/2001 | Tillett | 294/15 |
| 6,685,170 | B1 | 2/2004 | Gwynn | |
| 6,752,379 | B1 | 6/2004 | Wall | |
| 7,058,996 | B1 | 6/2006 | Merrill | |
| 7,107,632 | B2 | 9/2006 | Huff et al. | |
| 7,231,674 | B1 | 6/2007 | Cernik | |
| 7,798,469 | B2 | 9/2010 | Junka | |
| 7,823,862 | B2 | 11/2010 | Wakil | |
| 8,312,608 | B2 | 11/2012 | Head | |
| 8,313,130 | B2 | 11/2012 | Hazel | |
| 2008/0109957 | A1 | 5/2008 | Blancke | |
| 2008/0174134 | A1 * | 7/2008 | Niezur et al. | 294/158 |

* cited by examiner

*Primary Examiner* — Saul Rodriguez
*Assistant Examiner* — Gabriela Puig
(74) *Attorney, Agent, or Firm* — Livingston Loeffler, P.A.; Edward M. Livingston, Esq.; Bryan L. Loeffler, Esq.

(57) ABSTRACT

A toilet removal and disposal tray (1) for removing and transporting an old toilet (2) from a bathroom. The toilet removal and disposal tray has a planar base panel (3) having a perimeter edge (6) and a perimeter wall (7) extending upward a predetermined distance from the perimeter edge. The perimeter wall contains any liquids that leak from the toilet after the toilet has been uninstalled and placed on the toilet removal and disposal tray. A drain line connector (12) and/or one or more bolt hole connectors (13) attach the toilet to the toilet removal and disposal tray.

18 Claims, 4 Drawing Sheets

TOILET REMOVAL AND DISPOSAL TRAY

FIELD OF THE INVENTION

This invention relates to the removal of toilet from homes and other buildings, more particularly, to a tray used for removing a toilet from a bathroom and disposing of the toilet in a clean and sanitary manner.

BACKGROUND OF THE INVENTION

Toilets are commonly removed by a worker standing over a toilet and pulling the toilet up from the floor and then setting the toilet directly on the floor of the bathroom. The toilet is then carried to a truck or trash bin for disposal.

The removal of toilets can be unsanitary and cause a mess in the bathroom and throughout a home while the toilet is being carried outside. This can occur from water that has not completely drained from the toilet leaking onto the bathroom floor and other parts of a home including carpeted areas while being carried outside. This can also occur from the wax ring on the bottom of the toilet being set directly on the bathroom floor.

In addition, this is a dangerous task because toilets may be heavy and awkward to handle. The worker can easily suffer personal injuries, such as back injuries, from carrying such a heavy object in such an awkward position or damage items in the home, such as walls and/or furniture.

Therefore, a need exists for a toilet removal and disposal tray that attaches to the bottom of a toilet and protects the floor from water leaking from the toilet and from coming into contact with the used wax ring located on the bottom of the old toilet. In addition, a need exists for a toilet removal and disposal tray that allows a user to easily transport a toilet by sliding the tray, rolling the tray and/or carrying the tray using elongated handles.

The relevant prior art includes the following references:

| Pat. No. (U.S. Patent References) | Inventor | Issue/Publication Date |
|---|---|---|
| 3,391,905 | Burns | Jul. 09, 1968 |
| 5,074,572 | Delmerico et al. | Dec. 24, 1991 |
| 5,184,653 | Lacy | Feb. 09, 1993 |
| 5,373,593 | Decky et al. | Dec. 20, 1994 |
| 6,685,170 | Gwynn | Feb. 03, 2004 |
| 5,505,430 | Barnett | Apr. 09, 1996 |
| 5,556,076 | Jacquay | Sep. 17, 1996 |
| 6,135,466 | Irwin | Oct. 24, 2000 |
| 6,752,379 | Wall | Jun. 22, 2004 |
| 7,058,996 | Merrill | Jun. 13, 2006 |
| 7,107,632 | Huff et al. | Sep. 19, 2006 |
| 7,231,674 | Cernik | Jun. 19, 2007 |
| 2008/0109957 | Blancke | May 15, 2008 |
| 7,798,469 | Junka | Sep. 21, 2010 |
| 7,823,862 | Wakil | Nov. 02, 2010 |
| 8,313,130 | Hazel | Nov. 20, 2012 |
| 8,312,608 | Head | Nov. 20, 2012 |

SUMMARY OF THE INVENTION

The primary object of the present invention is to provide a toilet removal and disposal tray that attaches to the bottom of a toilet and protects the floor from water leaking from the toilet and from coming into contact with the used wax ring.

An additional object of the present invention is to provide a toilet removal and disposal tray that allows a user to easily transport a toilet by sliding the tray, rolling the tray and/or carrying the tray using elongated handles.

An additional object of the present invention is to provide a toilet removal and disposal tray that is compact and easily carried and stored, such as in a plumber's work truck.

An additional object of the present invention is to provide a toilet removal and disposal tray that may be disposable so that it can be thrown with the toilet after use.

The present invention fulfills the above and other objects by providing a toilet removal and disposal tray for removing and transporting an old toilet from a bathroom. The toilet removal and disposal tray has a planar base panel having a perimeter edge and a perimeter wall extending upward a predetermined distance from the perimeter edge. The perimeter wall contains any liquids that leak from the toilet after the toilet has been uninstalled and placed on the toilet removal and disposal tray. The toilet removal and disposal tray may also be lined with an absorbent material to soak up any water that drains from the toilet into the toilet removal and disposal tray, thereby further preventing water from leaking onto the floor.

The toilet is secured to the toilet removal and disposal tray by a drain line connector, which is preferably a rounded cylindrical projection, which is centrally located on the toilet removal and disposal tray and fits into the drain line of the toilet. Two bolt hole connectors, which are preferably finger-shaped projections, are located on either side of the drain line holder and further secure the toilet to the toilet removal and disposal tray by fitting through bolt holes located on the base of the toilet. The bolt hole connectors and drain line connector constructed out of a resilient material that provides outward pressure against the drain line and the bolt holes when squeezed inward, thereby creating a pressure fit to prevent the toilet removal and disposal tray from separating from the toilet when the toilet is lifted off the ground. Alternatively, the bolt hole connectors and drain line connector may have finger springs that automatically expand outward to lock the bolt hole connectors and drain line connector to the toilet.

The toilet and a toilet removal and disposal tray may be removed from the bathroom by sliding the a toilet removal and disposal tray across the floor or by carrying the a toilet removal and disposal tray using removable elongated handles that attach to the a toilet removal and disposal tray or by rolling the a toilet removal and disposal tray on wheels attached to the a toilet removal and disposal tray. The wheels may be attached directly to the toilet removal and disposal tray or to a dolly that is removably attachable to the a toilet removal and disposal tray.

The tray may be made of a reusable material or of a cheaper material so the tray can be discarded with the toilet after use.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
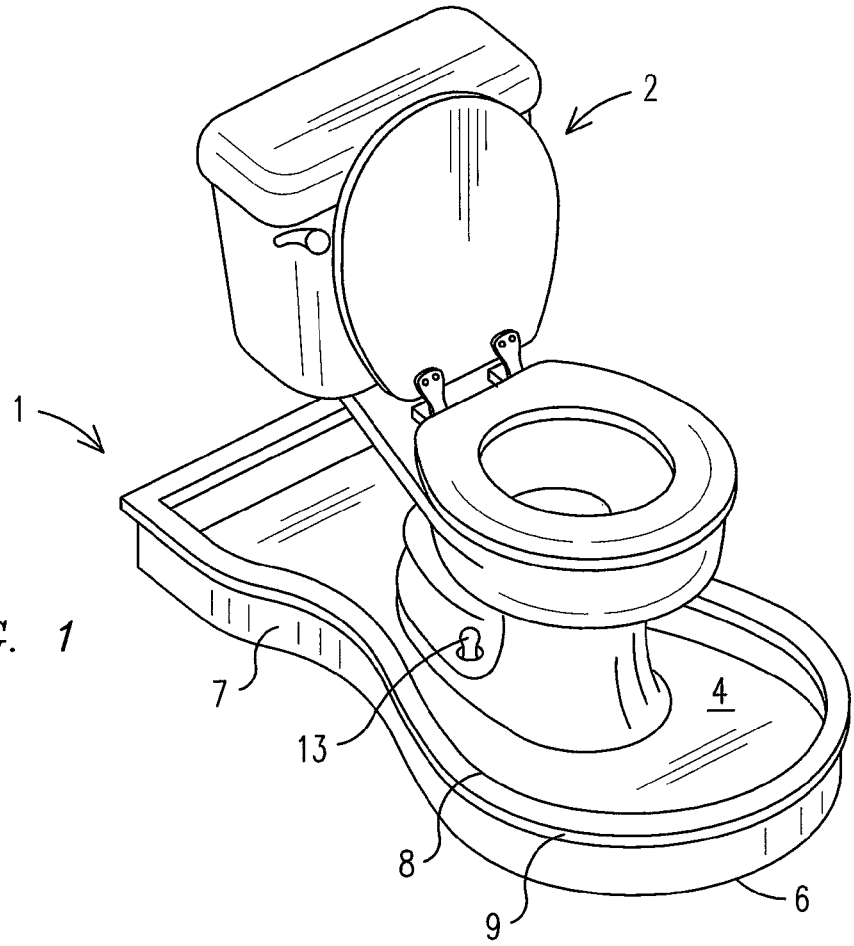
FIG. 1 is a perspective side view of a toilet removal and disposal tray having a toilet located therein.
Figure 2:
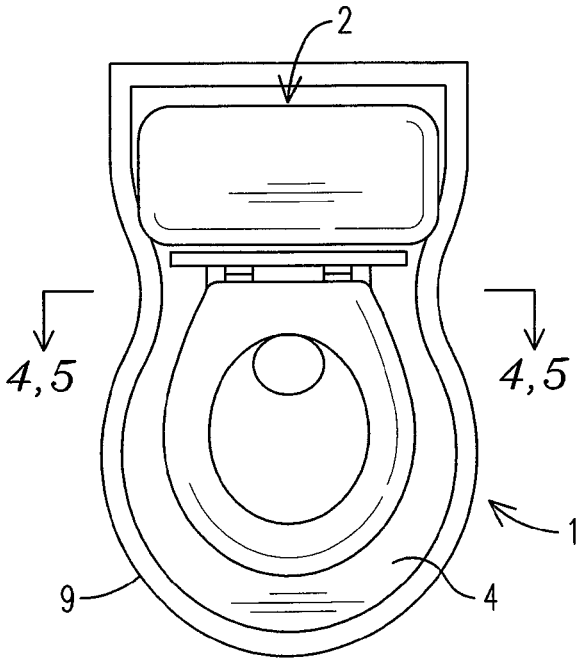
FIG. 2 is a top view of a toilet removal and disposal tray having a toilet located therein.

For purposes of describing the preferred embodiment, the terminology used in reference to the numbered accessories in the drawings is as follows:

1. toilet removal and disposal tray, generally
2. toilet
3. planar base panel
4. top surface of planar base panel
5. bottom surface of planar base panel
6. perimeter edge of planar base panel
7. perimeter wall
8. upper edge of perimeter wall
9. lip
10. elongated handle
11. slot
12. drain line connector
13. bolt hole connector
14. drain line
15. bolt hole
16. finger spring
17. wheel
18. absorbent liner With reference to FIGS. 1 and 2, a perspective side view and a top view, respectively of a toilet removal and disposal tray 1 having a toilet 2 located therein are illustrated. The toilet removal and disposal tray 1 comprises a planar base panel 3 having a top surface 4, a bottom surface 5, and a perimeter edge 6. A perimeter wall 7 extends upward a predetermined distance from the perimeter edge 6. An upper edge 8 of the perimeter wall 7 may have a lip 9 on one or both sides to provide a place for a user to grab the toilet removal and disposal tray 1 when moving the toilet 2.

Figure 3:
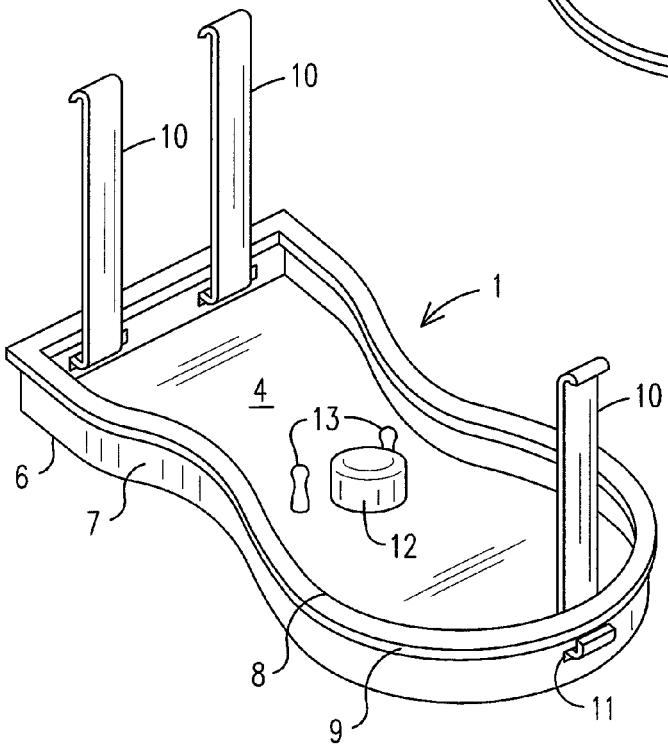
FIG. 3 is a perspective side view of a toilet removal and disposal tray having elongated handles attached thereto.

With reference to FIG. 3, a perspective side view of a toilet removal and disposal tray 1 having elongated handles 10 attached thereto is illustrated. The elongated handles 10 are preferably removably attachable to the toilet removal and disposal tray 1, and may be attached via a C-shaped distal end that hooks around the lip 9 on one or both sides of the perimeter wall 7 or through slots 11 located on the perimeter wall 7. Said slots 11 may also provide a user with areas to place his fingers through to pick up the toilet removal and disposal tray 1. Said slots may also be located on 11 either side of a toilet 2 when placed in the toilet removal and disposal tray 1 to provide attachment points for one or more straps, which may be used to secure the toilet removal and disposal tray 1 to the toilet 2.

Figure 4:
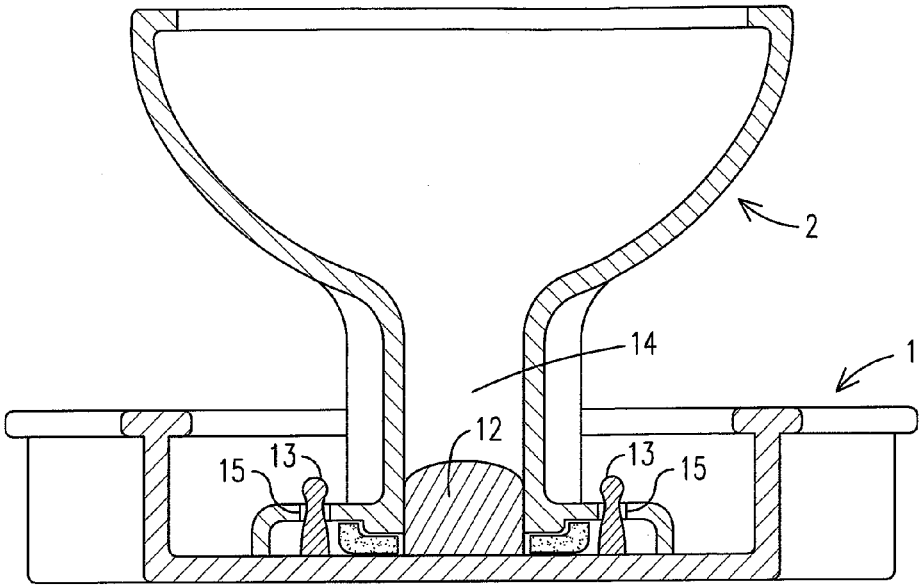
FIG. 4 is a cross sectional view along the line 2-2 of FIG. 2 is illustrated showing a toilet removal and disposal tray having a drain line connector and bolt hole connectors secured to the toilet by a pressure fit.

With reference to FIG. 4, a cross sectional view along the line 2-2 of FIG. 2 is illustrated showing a toilet removal and disposal tray 1 having a drain line connector 12 and bolt hole connectors 13 secured to the toilet 2 by a pressure fit. The toilet 2 is secured to the toilet removal and disposal tray 1 by a drain line connector 12, which is preferably a rounded cylindrical projection, which is centrally located on the toilet removal and disposal tray 1 and fits into the drain line 14 of the toilet 2. Two bolt hole connectors 13 (also illustrated in FIGS. 1 and 3), which are preferably finger-shaped projections, are located on either side of the drain line connector 12 and further secures the toilet to the toilet removal and disposal tray 1 by fitting through bolt holes 15 located on the base of the toilet 2. As illustrated here, the drain line connector 12 and bolt hole connectors 13 are constructed of a resilient material that provides outward pressure against the drain line 14 and the bolt holes 15 when squeezed inward, thereby creating a pressure fit.

Figure 5:
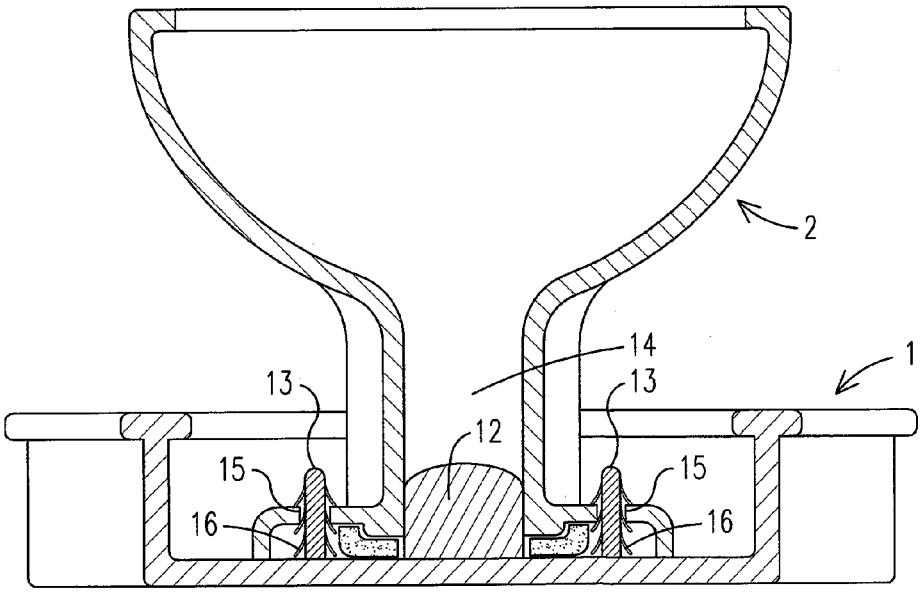
FIG. 5 is a cross sectional view along the line 2-2 of FIG. 2 is illustrated showing a toilet removal and disposal tray having a drain line connector and bolt hole connectors secured to the toilet by finger springs.

With reference to FIG. 5, a cross sectional view along the line 2-2 of FIG. 2 is illustrated showing a toilet removal and disposal tray 1 having a drain line connector 12 and bolt hole connectors 13 secured to the toilet 2 by finger springs. The toilet 2 is secured to the toilet removal and disposal tray 1 by a drain line connector 12, which is preferably a rounded cylindrical projection, which is centrally located on the toilet removal and disposal tray 1 and fits into the drain line 14 of the toilet 2. Two bolt hole connectors 13, which are preferably finger-shaped projections, are located on either side of the drain line connector 12 and further secures the toilet to the toilet removal and disposal tray 1 by fitting through bolt holes 15 located on the base of the toilet 2. As illustrated here, the drain line connector 12 and bolt hole connectors 13 have finger springs 16 that automatically expand outward to lock the bolt hole connectors 13 and drain line connector 12 to the toilet.

Figure 6:
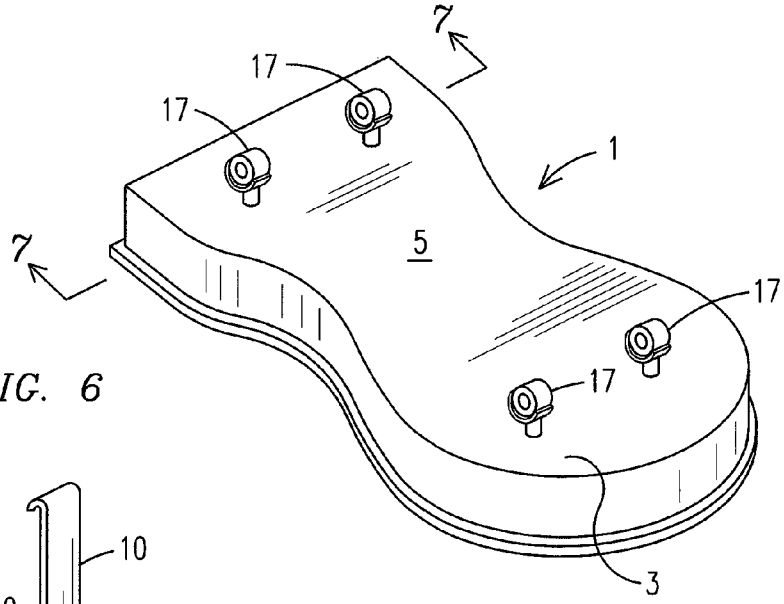
FIG. 6 is a perspective bottom view of a toilet removal and disposal tray of the present invention having wheels located thereon.

With reference to FIG. 6, a perspective bottom view of a toilet removal and disposal tray 1 of the present invention having wheels 17 located thereon. The toilet removal and disposal tray 1 may comprise wheels 17 may attached directly to the toilet removal and disposal tray 1 on the bottom surface 5 of the planar base panel 3 (as illustrated here). Alternatively, a dolly or second planar panel having wheels 17 attached thereto that is removably attachable to the toilet removal and disposal tray 1.

Figure 7:
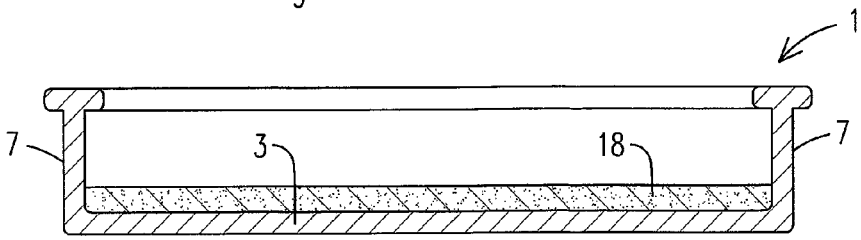
FIG. 7 is a cross sectional view along the line 6-6 of FIG. 6.

With reference to FIG. 7, a cross sectional view along the line 6-6 of FIG. 6 is illustrated. The toilet removal and disposal tray 1 may comprise an absorbent liner 18 adjacent to the perimeter wall and/or planar base panel 3 to soak up any water that drains from the toilet 2 into the toilet removal and disposal tray 1, thereby further preventing water from leaking onto the floor.

Figure 8:
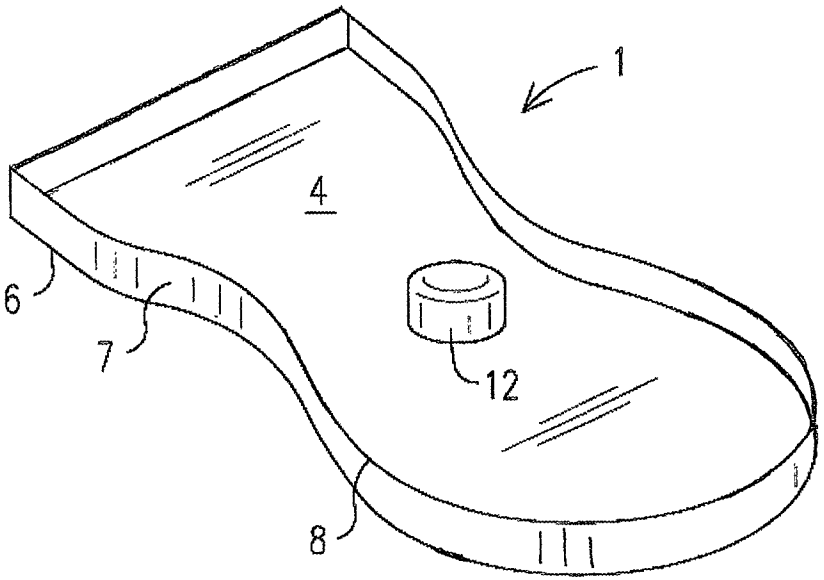
FIG. 8 is a perspective side view of a simplified toilet removal and disposal tray of the present invention.

With reference to FIG. 8, a perspective side view of a simplified toilet removal and disposal tray 1 of the present invention is illustrated. The toilet removal and disposal tray 1 comprises a planar base panel 3 having a top surface 4, a bottom surface 5, and a perimeter edge 6. A perimeter wall 7 extends upward a predetermined distance from the perimeter edge 6. The toilet 2 is secured to the toilet removal and disposal tray 1 by a drain line connector 12, which is preferably a rounded cylindrical projection, which is centrally located on the toilet removal and disposal tray 1 and fits into the drain line 14 of the toilet 2, as illustrated in FIGS. 4 and 5. The drain line connector 12 may also be angled, having a diameter that increases from top to bottom like a conical shape, to allow for easier insertion into the drain line 14 of the toilet 2.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A toilet removal and disposal tray comprising:

a planar base panel having a top surface, a bottom surface and a perimeter edge;

a perimeter wall extending upward a predetermined distance from the perimeter edge;

an upper edge located on the perimeter wall;

a drain line connector located on the planar base panel for attaching the toilet removal and disposal tray to a toilet;

said drain line connector further comprises at least one finger spring located thereon to engage the toilet when the toilet removal and disposal tray is attached to the toilet.

2. The toilet removal and disposal tray of claim 1 further comprising:

at least one bolt hole connector located proximate to said drain line connector for attaching the toilet removal and disposal tray to the toilet.

3. The toilet removal and disposal tray of claim 2 wherein:

said at least one bolt hole connector is made of a resilient material to create a pressure fit when the toilet removal and disposal tray is attached to the toilet.

4. The toilet removal and disposal tray of claim 2 wherein:

said at least one bolt hole connector further comprises at least one finger spring located thereon to engage the toilet when the toilet removal and disposal tray is attached to the toilet.

5. The toilet removal and disposal tray of claim 1 wherein:

said drain line connector is made of a resilient material to create a pressure fit when the toilet removal and disposal tray is attached to the toilet.

6. The toilet removal and disposal tray of claim 1 further comprising:

a lip located on the upper edge of the perimeter wall.

7. The toilet removal and disposal tray of claim 1 further comprising:

at least one elongated handle that engages the toilet removal and disposal tray to assist a user in transporting the toilet removal and disposal tray.

8. The toilet removal and disposal tray of claim 1 further comprising:

at least one wheel located on the toilet removal and disposal tray to assist a user in transporting the toilet removal and disposal tray.

9. The toilet removal and disposal tray of claim 1 further comprising:

an absorbent liner located in the toilet removal and disposal tray.

10. A toilet removal and disposal tray comprising:

a planar base panel having a top surface, a bottom surface and a perimeter edge;

a perimeter wall extending upward a predetermined distance from the perimeter edge;

an upper edge located on the perimeter wall;

at least one bolt hole connector located on the top surface of the planar base panel for attaching the toilet removal and disposal tray to a toilet;

said at least one bolt hole connector further comprises at least one finger spring located thereon to engage the toilet when the toilet removal and disposal tray is attached to the toilet.

11. The toilet removal and disposal tray of claim 10 further comprising:

a drain line connector located on the planar base panel for attaching the toilet removal and disposal tray to the toilet.

12. The toilet removal and disposal tray of claim 11 wherein:

said drain line connector is made of a resilient material to create a pressure fit when the toilet removal and disposal tray is attached to the toilet.

13. The toilet removal and disposal tray of claim 11 wherein:

said drain line connector further comprises at least one finger spring located thereon to engage the toilet when the toilet removal and disposal tray is attached to the toilet.

14. The toilet removal and disposal tray of claim 10 wherein:

said at least one bolt hole connector is made of a resilient material to create a pressure fit when the toilet removal and disposal tray is attached to the toilet.

15. The toilet removal and disposal tray of claim 10 further comprising:

a lip located on the upper edge of the perimeter wall.

16. The toilet removal and disposal tray of claim 10 further comprising:

at least one elongated handle that engages the toilet removal and disposal tray to assist a user in transporting the toilet removal and disposal tray.

17. The toilet removal and disposal tray of claim 10 further comprising:

at least one wheel located on the toilet removal and disposal tray to assist a user in transporting the toilet removal and disposal tray.

18. The toilet removal and disposal tray of claim 10 further comprising:

an absorbent liner located in the toilet removal and disposal tray.

* * * * *